US012774563B2

(12) United States Patent
Lewis et al.

(10) Patent No.: US 12,774,563 B2
(45) Date of Patent: Oct. 27, 2026

(54) FOAM-ASSISTED APPLICATION OF SIZING AGENTS TO PAPER PRODUCTS

(71) Applicant: SOLENIS TECHNOLOGIES, L.P., Wilmington, DE (US)

(72) Inventors: Ashley Hawkins Lewis, Wilmington, DE (US); Scott Romak Lewis, Wilmington, DE (US); Susan M Ehrhardt, Haddonfield, NJ (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 335 days.

(21) Appl. No.: 18/152,876

(22) Filed: Jan. 11, 2023

(65) Prior Publication Data

US 2023/0279614 A1 Sep. 7, 2023

Related U.S. Application Data

(60) Provisional application No. 63/266,638, filed on Jan. 11, 2022.

(51) Int. Cl.

| | |
|---|---|
| ***D21H 21/16*** | (2006.01) |
| ***D21H 19/12*** | (2006.01) |
| ***D21H 21/18*** | (2006.01) |
| ***D21H 23/46*** | (2006.01) |

(52) U.S. Cl.

CPC ..... *D21H 21/16* (2013.01); *D21H 19/12* (2013.01); *D21H 21/18* (2013.01); *D21H 23/46* (2013.01)

(58) Field of Classification Search

CPC ..... D21H 21/16; D21H 19/12; D21H 21/18; D21H 23/46; D21H 17/16; D21H 17/17; D21H 17/62; D21H 21/56

See application file for complete search history.

(56) References Cited

U.S. PATENT DOCUMENTS

| | | | | |
|---|---|---|---|---|
| 1,086,525 A | | 2/1914 | Groehn | |
| 3,210,240 A | | 10/1965 | Read et al. | |
| 4,099,913 A | * | 7/1978 | Walter | D06B 19/0094 252/8.61 |
| 4,184,914 A | * | 1/1980 | Jenkins | D21H 23/00 427/361 |
| 4,263,344 A | * | 4/1981 | Radvan | B41M 5/155 427/151 |

(Continued)

FOREIGN PATENT DOCUMENTS

| | | | | |
|---|---|---|---|---|
| CN | 86101888 A | | 9/1987 | |
| CN | 118661003 A | * | 9/2024 | D21H 17/16 |

(Continued)

OTHER PUBLICATIONS

ISA/US, International Search Report and Written Opinion issued in Int. Appl. No. PCT/US2023/060442 mailed Apr. 12, 2023.

(Continued)

*Primary Examiner* — Jose A Fortuna

(74) *Attorney, Agent, or Firm* — Ingrassia Fisher & Lorenz LLP

(57) ABSTRACT

Methods for manufacturing sized paper products are provided. An exemplary method includes producing a foam of water, air, a foaming agent, and a sizing agent. Further, the exemplary method includes applying the foam to a web and processing the web to form the product.

20 Claims, 11 Drawing Sheets

(56) References Cited

U.S. PATENT DOCUMENTS 4,297,860 A * 11/1981 Pacifici ..... B01F 25/45241 68/900
4,353,993 A * 10/1982 McCrossin ..... D21H 21/56 521/65
4,571,360 A * 2/1986 Brown ..... D21H 17/00 521/85
4,597,831 A * 7/1986 Anderson ..... D21H 21/56 162/158
4,773,110 A * 9/1988 Hopkins ..... D06B 19/0094 118/410
5,089,296 A * 2/1992 Bafford ..... D06M 23/04 427/209
5,164,046 A * 11/1992 Ampulski ..... D21H 23/50 162/158
5,672,249 A 9/1997 Mnson et al.
5,851,352 A 12/1998 Vinson et al.
5,928,472 A 7/1999 Evans et al.
6,761,800 B2 * 7/2004 Capizzi ..... B05D 1/28 162/158
6,797,116 B2 * 9/2004 Capizzi ..... D21H 21/56 427/244
6,852,196 B2 * 2/2005 Capizzi ..... D21H 23/26 427/244
6,875,308 B2 * 4/2005 Kajander ..... B32B 13/14 162/185
6,977,026 B2 * 12/2005 Liu ..... D21H 21/22 427/209
7,285,183 B2 * 10/2007 Kajander ..... B32B 13/14 162/135
8,871,055 B2 10/2014 Ehrhardt
10,106,932 B2 10/2018 Anderson et al.
10,358,772 B2 * 7/2019 Heiskanen ..... C09D 103/02
10,364,533 B2 * 7/2019 Heiskanen ..... D21H 21/24
10,597,824 B2 3/2020 Coutinho et al.
11,365,515 B2 * 6/2022 Luo ..... D21H 17/455
12,203,220 B2 * 1/2025 Castro ..... D21H 19/32
12,258,715 B2 * 3/2025 Backfolk ..... D21H 11/18
2003/0085009 A1 5/2003 Capizzi et al.
2007/0083018 A1 * 4/2007 Liu ..... D21H 17/13 524/588
2008/0066881 A1 3/2008 Riehle et al.
2008/0185114 A1 * 8/2008 Shannon ..... D21H 17/455 162/168.1
2017/0335522 A1 11/2017 Heiskanen et al.
2019/0309480 A1 * 10/2019 Luo ..... D21H 19/10
2021/0002830 A1 1/2021 Hietaniemi
2022/0243401 A1 * 8/2022 Backfolk ..... D21H 21/56
2023/0002974 A1 1/2023 Hemphill et al.
2023/0160147 A1 * 5/2023 Bliss ..... D21H 17/56 162/158
2023/0279614 A1 * 9/2023 Lewis ..... D21H 21/16 162/135
2024/0133122 A1 * 4/2024 Kiviranta ..... D21H 21/16
2024/0229361 A9 * 7/2024 Kiviranta ..... D21H 21/18

FOREIGN PATENT DOCUMENTS

EP 0195459 B1 * 3/1986 ..... D21H 3/02
EP 0195459 A1 * 3/1989 ..... D21H 3/02
KR 20240126069 A * 8/2024 ..... D21H 23/46
SE 1651026 A1 * 1/2018 ..... D21H 21/56
SE 543902 C2 * 9/2021 ..... D21H 21/56
TW 202340577 A * 10/2023 ..... D21H 17/16
WO WO-0148313 A1 * 7/2001 ..... D21H 21/16
WO 2015080937 A1 6/2015
WO WO-2020230035 A1 * 11/2020 ..... C09D 103/02

OTHER PUBLICATIONS

XP086481679; Arancibia Fernando et al: "Stabilization of the emulsion of Alkenyl Succinic Anhydride (ASA) in water using cellulose nanofibrils", Chemical Engineering Science, Oxford, GB, vol. 233, Jan. 5, 2021 (Jan. 5, 2021), ISSN: 0009-2509, DOI: 10.1016/J.CES.2020.116407 [retrieved on Jan. 5, 2021] * Sections 2.3 and 2.7 *.

* cited by examiner

FOAM-ASSISTED APPLICATION OF SIZING AGENTS TO PAPER PRODUCTS

CROSS-REFERENCE TO RELATED APPLICATIONS

This application claims the benefit of U.S. Provisional Application No. 63/266,638 filed Jan. 11, 2022.

TECHNICAL FIELD

The present disclosure relates to the field of applying additives to wet paper webs. More particularly, the present disclosure relates to the application of sizing agents using foamed application techniques to wet newly-formed webs in the production of a paper product.

BACKGROUND

In paper manufacturing, additives are introduced into the papermaking process to improve paper properties. For example, known additives improve resistance to wetting and penetration by liquid, paper strength, drainage properties, retention properties, and so on.

In a conventional papermaking machine, pulp is prepared for papermaking in a stock preparation system. Chemical additives, dyes, and fillers are sometimes added into the thick stock portion of the stock preparation system, which operates at a consistency of from 2.5 to 5% dry solids; additives may be added into the blend chest, the paper machine chest, a pulp suction associated with either of these chests, or other locations. In the thin stock circuit of the stock preparation system, the pulp is diluted from a consistency of 2.5 to 3.5% to a consistency of from 0.5 to 1.0% dry solids prior to passing through the thin stock cleaners, screens, an optional deaeration system, and approach flow piping. During or after this dilution, additional chemical additives may be added to the pulp, either in a pump suction, or in the headbox approach flow piping. Addition of chemical additives in the thick stock or the thin stock portions of the stock preparation system would be considered "wet-end addition" as used herein.

The fully prepared stock slurry, at from 0.5 to 1.0% dry solids consistency, is typically pumped to the headbox, which discharges the stock slurry onto a moving continuous forming fabric. The forming fabric may have the form of a woven mesh. Water drains through the forming fabric and the fibers are retained on the forming fabric to form an embryonic web while traveling from the headbox to the press section. As water drains away, the water content of the embryonic web may drop from 99 to 99.5% water to 70 to 80% water. Further water may be removed by pressing the wet web with roll presses in a press section, from which the wet web may exit with only from 50 to 60% water content (that is, a consistency of from 40 to 50% dry solids). Further water is typically removed from the web by evaporation in a dryer section, from which the web may exit with a consistency of from 90 to 94% dry solids. The sheet may then be treated in a size press and post dryers. The sheet may then be calendered to improve the surface smoothness of the sheet, and to control the sheet thickness or density to a target value. The sheet is typically then collected on a reel.

As explained above, chemical additives may be introduced into the pulp within the stock preparation section, in what is known as "wet-end addition". In some cases, additives may also be added via either spraying onto the wet web in the forming section, or by using a size press to apply the additives to the dry sheet. Spray application and size press addition of additives are optional.

In wet-end applications, the chemistry is distributed throughout the web and the retention of the chemical additives varies depending on the papermaking system and the chemistry being applied. There are additional considerations with wet-end application of additives such as deposits on the forming fabric and other surfaces within the forming section, and potential cycle up issues (accumulation of wet-end additives within the recirculated water due to poor fixation of the additives to the fibers). Spray application can be somewhat problematic due to accumulation of overspray on nearby surfaces, uneven distribution due to spray patterns, and the plugging of the spray nozzles. Size press applications are not performed on the wet-end of the papermaking machine and do not have the advantages of applying chemistry to a wet sheet prior to or during formation.

Further, chemical additives applied via traditional wet-end application typically provide relatively uniform distribution of additives throughout the Z-direction of the web, which may be desirable, or may result in less additive in some Z-direction locations within the sheet than desired. Thus, the wet-end approach is not targeted and can result in some cost inefficiencies in the chemistry application.

Sizing technologies have traditionally been applied via wet-end or size press addition into the paper making system. As with most chemistries applied to the wet-end, the performance in the final paper sheet is dictated by retention through the papermaking process and distribution in the paper sheet. Sizing chemistries typically contain hydrophobic groups and therefore may have trouble distributing in the wet-end and retaining in the formed paper sheet. This lack of retention of sizing impacts the sizing properties of the sheet and requires higher dosages of sizing agents to be used. Additionally, sizing agents not retained in the sheet can lead to unwanted deposits in the paper and/or on the paper machine equipment as well as accumulation in the white water which may result in foaming.

Most sizing applications are tuned to improve the sizing retention, distribution, and ultimately performance. These are typically adjusted through application of best practices in terms of dilutions, addition points, papermaking pH, and co-additives. In some cases, the best conditions for the application of sizing agents may not be the best for the overall papermaking system and a compromise is needed.

Accordingly, it is desirable to provide a method for manufacturing paper with improved application of sizing agents. In addition, it is desirable to provide a method for manufacturing paper in which sizing chemistry also referred to as a sizing agent or agents is applied via foam application. Further, it is desirable to provide a method for manufacturing paper that allows for a desired distribution of sizing agents within the sheet. Furthermore, other desirable features and characteristics of embodiments will become apparent from the subsequent detailed description and the appended claims, taken in conjunction with the accompanying drawings and the foregoing technical field and background.

BRIEF SUMMARY

This summary is provided to introduce a selection of concepts in a simplified form that are further described below in the detailed description section.

In an exemplary embodiment, a method for manufacturing a sized paper product is provided. In an exemplary embodiment, the method includes producing a foam of water, air, a foaming agent, and a sizing agent. Further, the method includes applying the foam to a web. Also, the method includes processing the web to form the product.

In another exemplary embodiment, a method for manufacturing a sized paper product includes applying a foam to an embryonic web, wherein the foam comprises a sizing agent. Further, the method includes concentrating the sizing agent at a targeted region within the embryonic web while processing the embryonic web to form the product.

In another exemplary embodiment, a method for introducing a sizing agent into a paper product is provided. The method includes producing a foam of water, air, and the sizing agent. Further, the method includes applying the foam to an embryonic web. Also, the method includes processing the embryonic web to form the paper product.

Other desirable features will become apparent from the following detailed description and the appended claims, taken in conjunction with the accompanying drawings and this background.

BRIEF DESCRIPTION OF THE DRAWINGS

A more complete understanding of the subject matter may be derived from the following detailed description taken in conjunction with the accompanying drawings, wherein like reference numerals denote like elements, and wherein.

DETAILED DESCRIPTION

Figure 1:
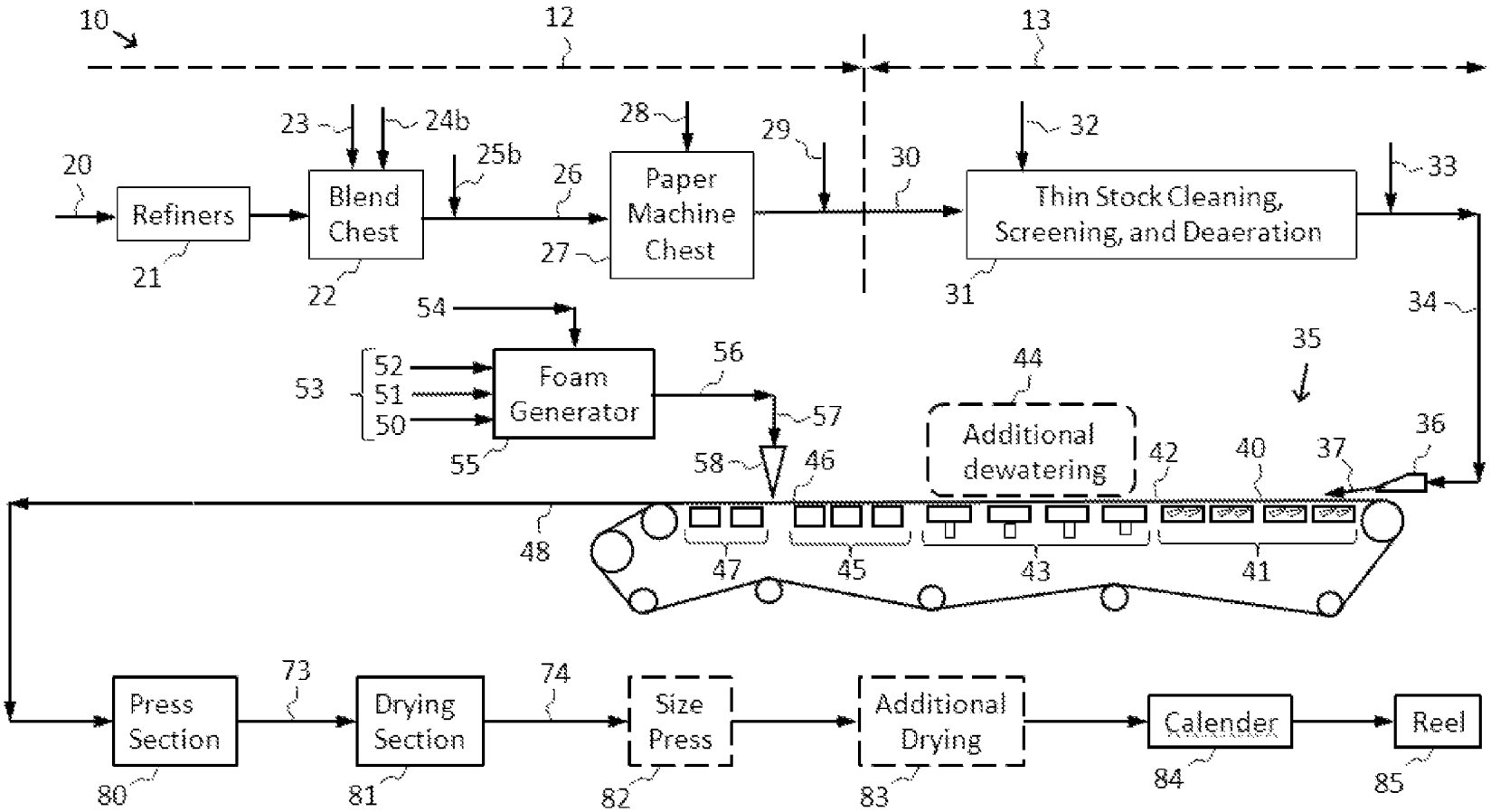
FIG. 1 is a schematic of a papermaking apparatus in accordance with various embodiments.
Figure 2A:
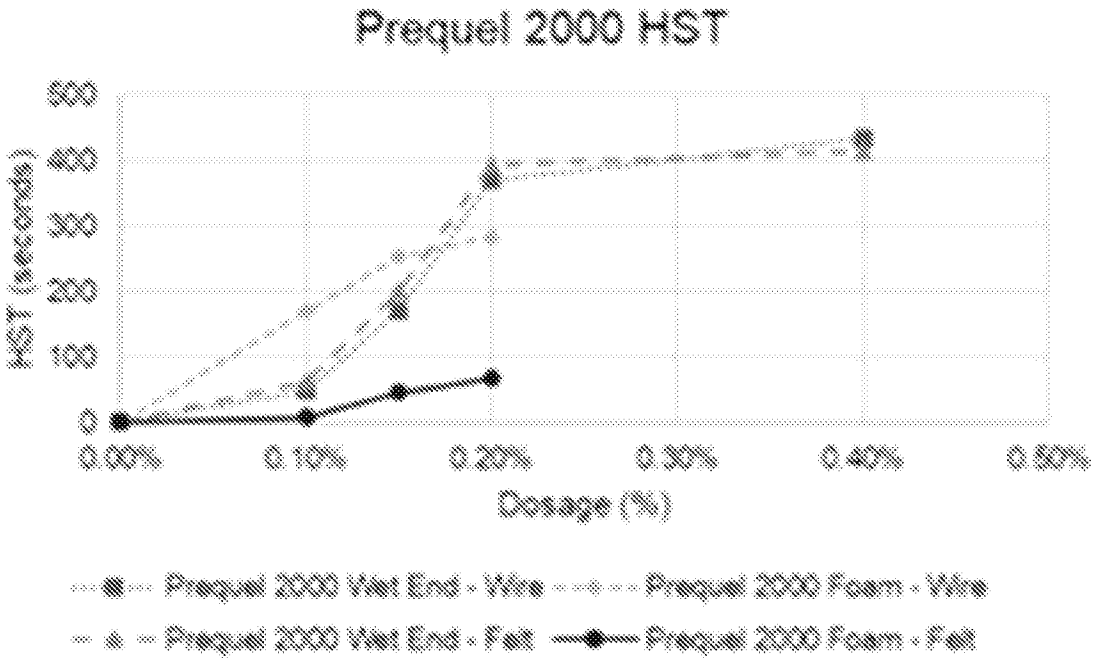
FIGS. 2A-2F and 3A-3D are sizing results plots for Examples/Comparative Examples 1-3.
Figure 2B:
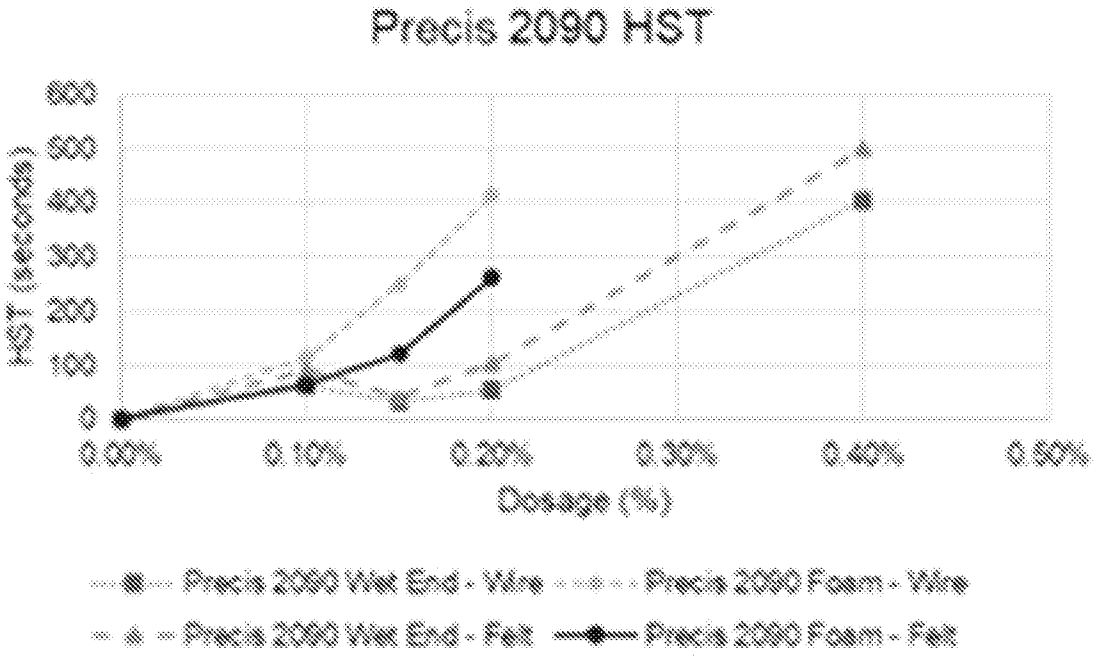
Figure 2C:
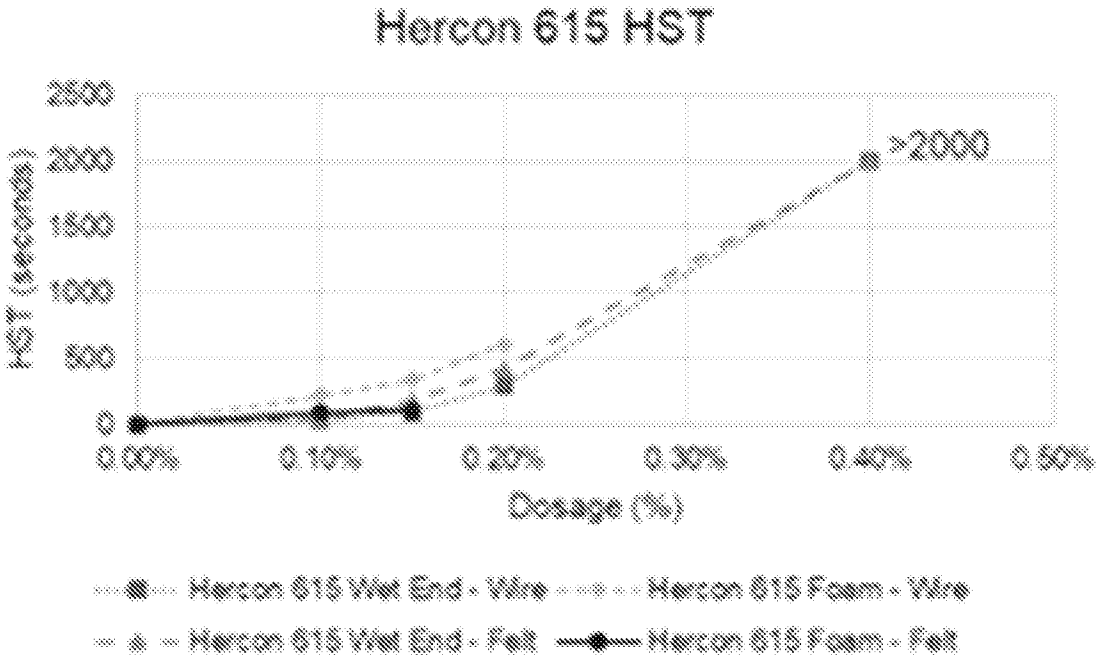
Figure 2D:
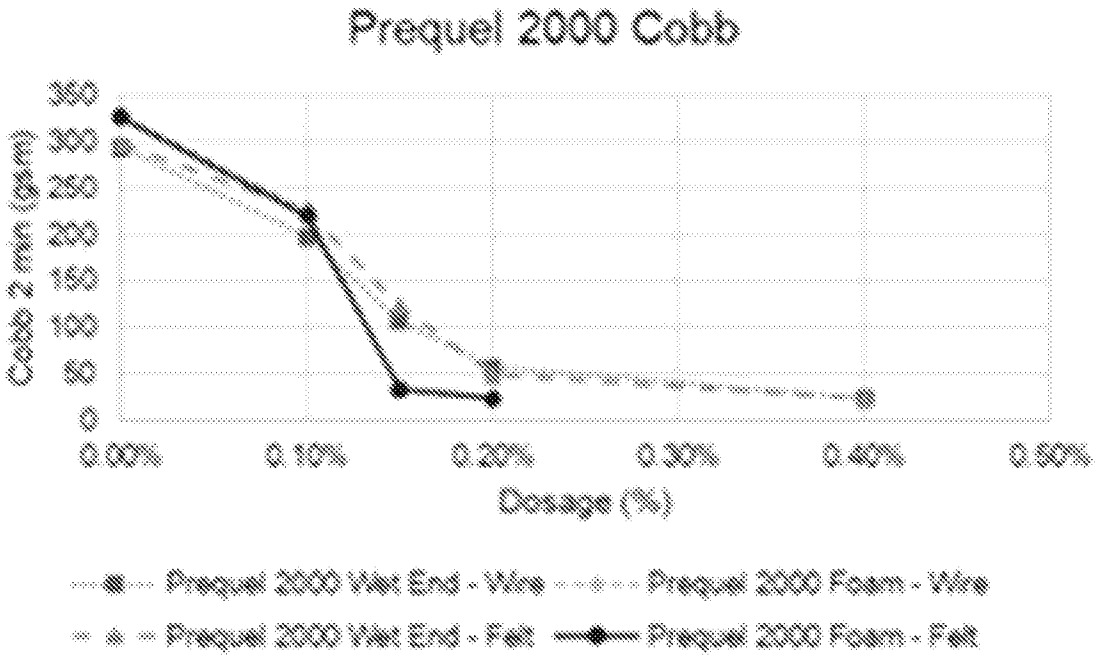
Figure 2E:
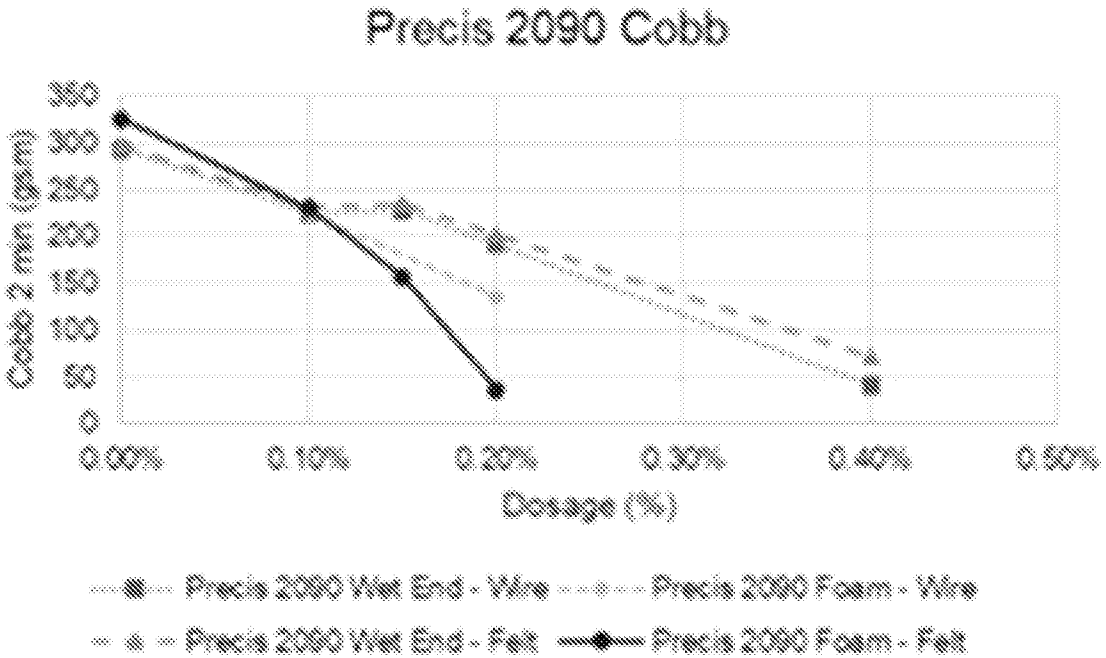
Figure 2F:
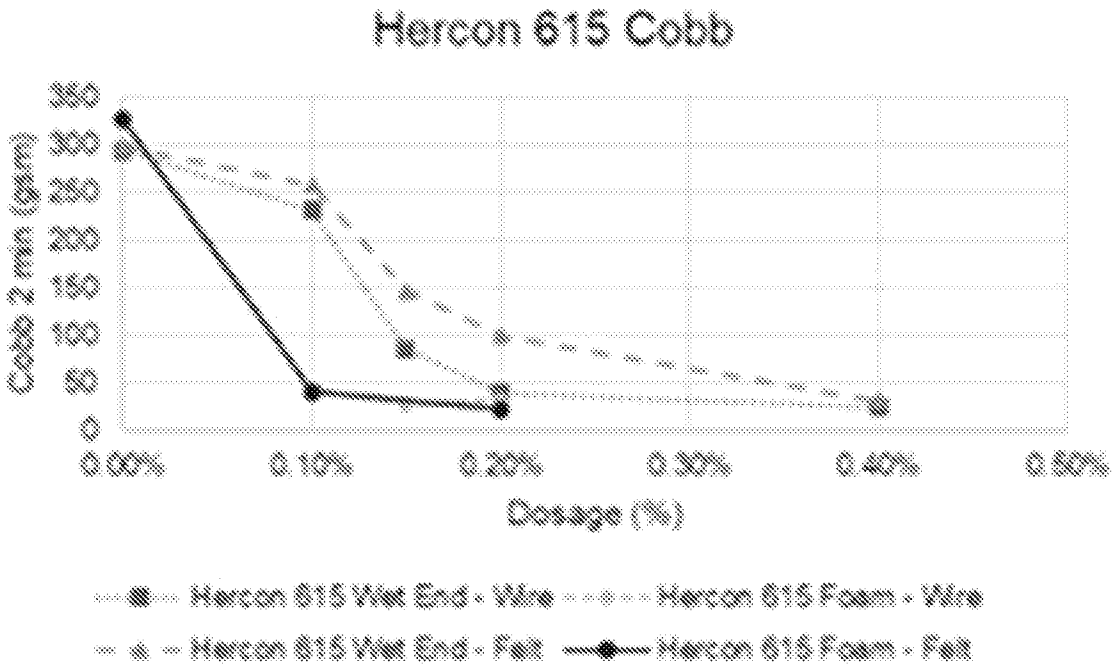
Figure 3A:
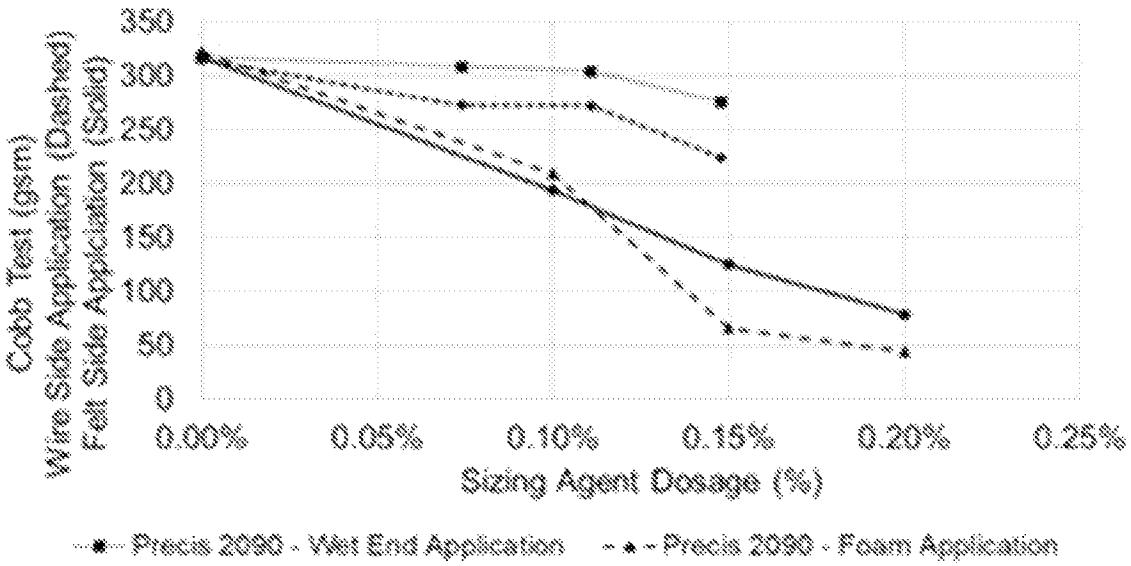
Figure 3B:
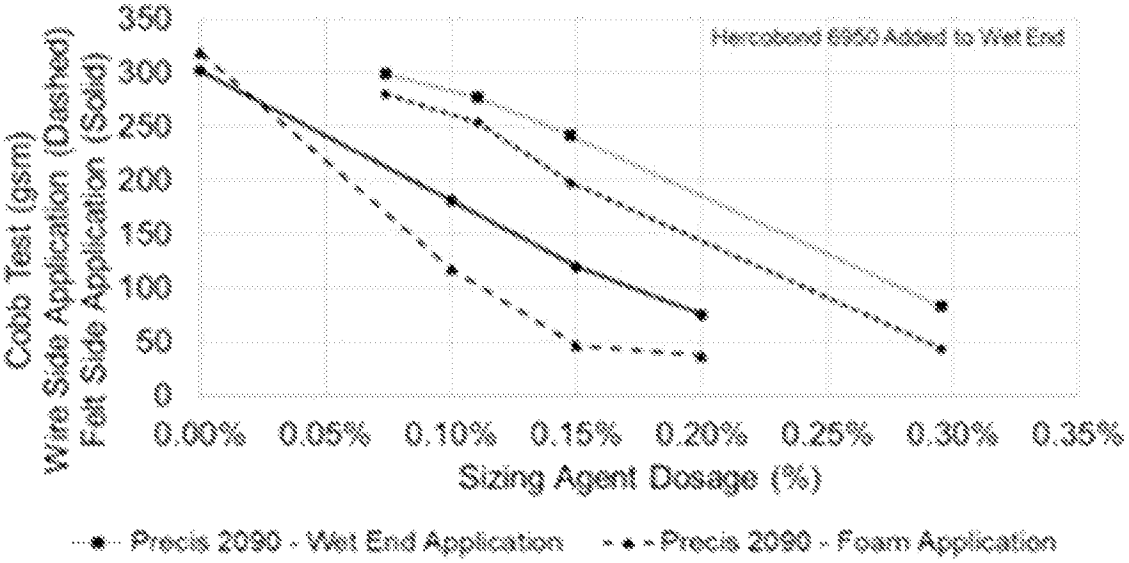
Figure 3C:
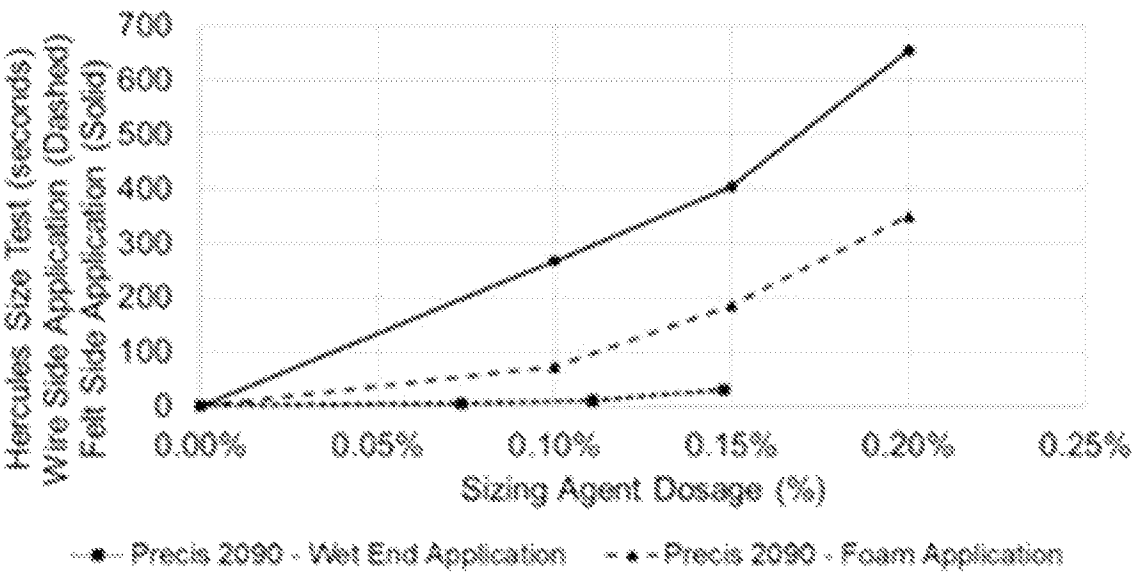
Figure 3D:
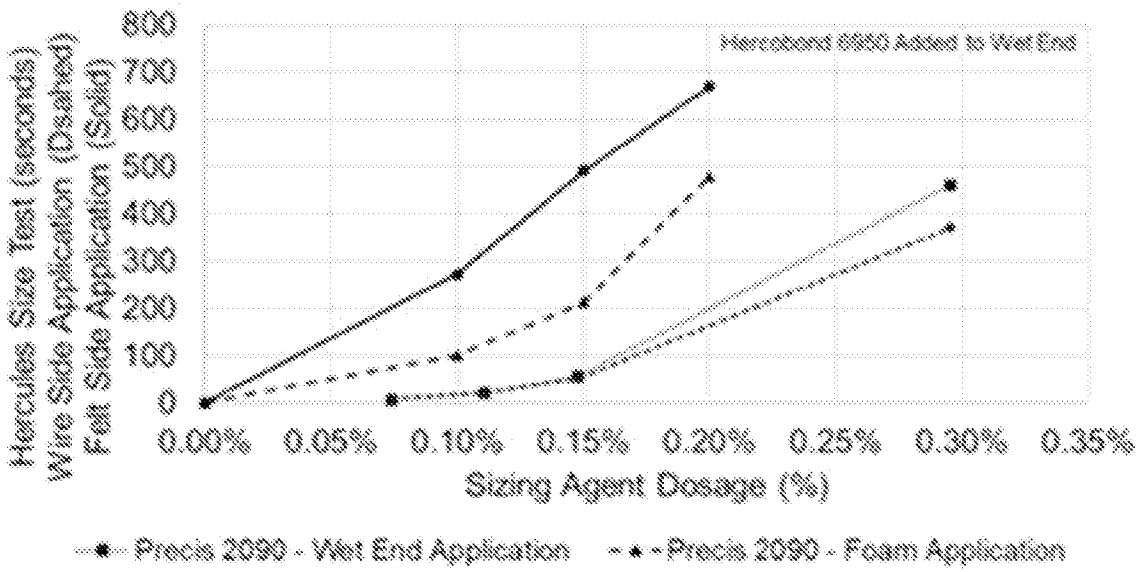

The following detailed description is merely illustrative in nature and is not intended to limit the embodiments of the subject matter or the application and uses of such embodiments. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the systems and methods defined by the claims. Furthermore, there is no intention to be bound by any expressed or implied theory presented in the preceding Technical Field, Background, Brief Summary or the following Detailed Description. For the sake of brevity, conventional techniques and compositions may not be described in detail herein.

Herein, the term "paper" is used, for convenience, to mean all forms of paper, paperboard and related products including molded three-dimension products such as cups, bowls, containers, packaging, and the like. As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±ten percent. Thus, "about ten" means nine to eleven. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated.

As described herein, paper manufacturing methods, particularly through foam addition, provide paper products with improved sizing properties as compared to processes using wet-end application of sizing chemistries.

Embodiments of the present disclosure relate to introducing sizing agents to paper substrates via a foam-assisted application technique. The technique distributes the sizing agents in a foam that is then applied to the formed wet web. In exemplary embodiments, the sizing agent is applied via foam at a location prior to, or upstream of, a vacuum box. At the vacuum box, the foam is pulled into the wet web prior to pressing and drying. In other embodiments, the foam may be applied at a different location depending on the equipment configuration. Typically, the foam is applied prior to the dryer section to allow penetration of the foam and chemistry into the wet web prior to reactions in the dryer section.

Application of sizing agent or agents to the wet web via foam application can be advantageous in that the chemistry is applied to the wet-end, as with traditional approaches, but some of the typical disadvantages are avoided. Foam application can be expected to have better sizing agent retention, thereby avoiding deposits, and the application to the wet web surface allows some benefits of the spray applications while providing a more even distribution of the sizing agent across the surface of the sheet.

Embodiments using foam application of sizing agents to paper substrates have advantages over the standard practices in terms of retention, efficiency, cost, and targeted application. For example, foam application processes have shown improved sizing performance with a reduction in the sizing agent dosage required to achieve particular desired properties in the paper product. In testing, it was found that the amount of sizing agent required to achieve a target value of Cobb or HST was reduced by using the foam application process. Without wishing to be bound by theory, it has been hypothesized that the application via foam to the wet web allows for improved sizing retention, and/or an improved distribution in the sheet, and therefore improved sizing properties in the paper. The magnitude of the reduction in dose to achieve a desired Cobb value was dependent on the type of sizing agent and sizing target.

As described herein, sizing agents are applied via foam to the surface of a web. The foam is pulled into the web via a vacuum or negative pressure force, which can provide multiple advantages over traditional approaches. For example, the concentrations in the foam and application to the surface can be optimized to provide better retention in the web as compared to conventional wet-end applications. Further, foam is more easily controlled and managed than a spray application, and foam does not cause accumulation of sprayed component droplets on surfaces as overspray. Also, there is potential to apply higher viscosity chemistries as well as higher concentrations of chemistry in a foam as compared to typical limitations of spray application. Additionally, the application to the web surface allows for tunable penetration into the web and a controlled distribution to and through one surface as opposed to an even distribution throughout the Z-direction of the web.

It is contemplated herein that sizing agents are applied via foam to the surface of a web when the web has a selected pulp fiber consistency, such as less than 45% dry solids. In certain embodiments, the selected pulp fiber consistency is less than 30% dry solids, such as less than 20% dry solids, less than 15% dry solids or less than 10% dry solids. In certain embodiments, the selected pulp fiber consistency is greater than 1% dry solids, such as greater than 2% dry solids, greater than 5% dry solids or greater than 6% dry solids. In certain embodiments, sizing agents are applied via foam to the surface of an embryonic web.

An exemplary embryonic web has a pulp fiber consistency of less than 50% dry solids, such as less than 45% dry solids, for example less than 40% dry solids, such as less than 35% dry solids, for example less than 30% dry solids, such as less than 25% dry solids, for example less than 20% dry solids, or less than 15% dry solids. An exemplary embryonic web has a consistency of greater than 5% dry solids, such as greater than 6% dry solids, for example greater than 7% dry solids, such as greater than 8% dry solids, for example greater than 9% dry solids, or greater than 10% dry solids.

Referring now to the Figures, a schematic of an apparatus 10 for manufacturing a paper product, such as paper, paper board, or a molded three-dimensional paper product like cups, bowls, containers, packaging or the like, is provided in FIG. 1. In FIG. 1, the apparatus 10 is designed to apply a foamed formulation, including a sizing agent, to a web, such as a wet web or embryonic web.

The apparatus 10 includes a thick stock circuit 12 and a thin stock circuit 13. In FIG. 1, the flow of a component stock 20 is illustrated using solid arrows. In an embodiment, the thick stock section 12 comprises one or more refiners 21 configured to improve fiber-fiber bonding in the thick stock component 20 by making fibers of the thick stock component 20 more flexible and by increasing their surface area through mechanical action applied to the component thick stock 20 at a consistency of from 2.0 to 5.0% dry solids.

In the illustrated embodiment, after passing through the refiners 21, the thick stock component 20 enters a blend chest 22. In the blend chest 22, the stock component 20 may optionally be blended with an additional stock component or components 23 from other sources, for example, broke. Additionally, the stock component 20 may be blended with chemical additives 24*b* in the blend chest 22. After exiting from the blend chest 22, the stock components 20 and 23 may be diluted through the addition of water 25*b* in order to control the consistency of the stock components 20 and 23 to be within a pre-determined target range to form a blended and consistency adjusted stock 26. The blended and consistency adjusted stock 26 then enters a paper machine chest 27 where additional chemical additives 28 may be added. In an embodiment, as the stock exits from the paper machine chest 27, the stock is diluted with a large amount of water 29 to control the consistency of the stock to be from 0.5 to 1.0% dry solids as the stock exits the thick stock circuit 12. Stock 30, having a consistency of from 0.5 to 1.0% dry solids, enters the thin stock circuit 13.

In an exemplary embodiment, within the thin stock circuit 13, the stock 30 may pass through low consistency cleaning, screening, and deaeration devices. In exemplary embodiments, additional chemical additives 32 may be added to the stock 30 in any number of locations within the cleaning, screening, and deaeration area 31, for example at location 32, and also at location 33 in the approach flow piping 34 to the forming section 35. The stock 30 can now be called 37 as it enters the forming section 35. In exemplary embodiments, in the forming section 35, a headbox 36 distributes the stock 37 onto a moving woven fabric (the "forming fabric") 40. In exemplary embodiments, the forming fabric 40 transports the stock 37 over one or more boxes of hydrafoils 41, which serve to drain water from the stock 37 and thereby increase the consistency of the stock 37 to form an embryonic web 42. In exemplary embodiments, when the embryonic web 42 has a consistency of from 2 to 3% dry solids, the web 42 then passes over one or more low vacuum boxes 43, which are configured to apply a "low" vacuum to the embryonic web 42 in order to remove additional water from the web. The embryonic web 42 may also be dewatered further by an optional additional dewatering unit 44 mounted above the forming fabric 40. The embryonic web 42 be may subsequently pass over one or more "high" vacuum boxes 45, where a higher vacuum, i.e., stronger negative pressure, force removes additional water until the web 42 has a consistency of from 6 to 15% dry solids. The wet web is now referred to as 46.

In an exemplary embodiment, water 50, a sizing agent 51, and a foaming agent 52 (if desired), collectively called the foaming formulation 53, is mixed with a gas 54 (usually air) in a foam generator 55 to create a foam 56. In certain embodiments, the foaming formulation may further include one or more dry strength agent, an anchoring agent, or other desired components.

In an exemplary embodiment, after the incorporation of gas 54 into the foaming formulation 53, the resultant foam 56 is conveyed via a pipe or a hose 57 to a foam distributor 58 where the foam 56 is applied onto the wet web 46. In an exemplary embodiment, the foam 56 is applied between a high vacuum box 45 and a post-application high vacuum box 47. The vacuum created by the high vacuum box 47 following the foam application draws the foam 56 into the wet web 46. The foam coated and vacuum treated web, now called 48, is also typically at a somewhat higher consistency, from 8 to 12%, due to the influence of vacuum from the high vacuum boxes 47.

As shown in FIG. 1, the web 48 enters the pressing section 80, where press rolls press additional water from the wet web 48. The web exits the pressing section with a consistency of from 40 to 55% dry solids, and is then called web 73. Web 73 enters a drying section 81, where heated dryer cylinders heat the web 73 and evaporate additional water from the web 73. The wet web 73 is dried to from 6 to 10% consistency (90 to 94% dry) within the drying section and is now called dry web 74. After the drying section 81, the dry web 74 may go directly to the calender 84 and reel 85, or it may be treated with an additional surface size in the optional size press 82; if so treated, it is then dried again with additional dryers 83. Following the drying section 81 or optionally size press 82 and additional drying 83, the sheet 74 may be treated with a calender 84 to improve surface smoothness and control sheet thickness, then the sheet may be reeled by a reel device 85.

It is contemplated that specific structural details of apparatuses 10 may differ from one manufacturing location to another. For example, thick stock system 12 shows refiners 21 acting on stock component 20, but not on additional stock component or components 23. In some cases, other stock components may be blended with stock component 20 before refiners 23 and co-refined with stock component 20. There may be fewer or more foil boxes 41, low vacuum boxes 43, or high vacuum boxes 45 prior to the addition of foamed paper additives 56. Additional dewatering step 44 for example is identified as optional. Size press 82 combined with additional drying 83 are likewise shown as optional—they may be present in some cases and absent in other cases. Many other similar variations are contemplated and within the scope of the disclosure.

Adjustment of the process variables (amount of wet foam coating per unit of sheet area, time and strength of vacuum application before and after the addition of foamed additives, web thickness, web % dry solids at the time of foamed additives application, and many other variables) can allow the distribution of the sizing agents to be altered. This allows a more even distribution of sizing agents within the sheet, or a higher concentration of sizing agents closer to the surface where the foam was applied or at a desired depth in the Z-direction of the sheet, to be chosen.

Sizing Agents

The treatment of paper to inhibit the pickup of liquid penetrants is referred to as sizing. There are two basic approaches to sizing: 1) reducing the dimensions of the pores in the sheet by the application of starch or other film formers (e.g., polyvinyl alcohol, carboxymethyl cellulose) to the surface and 2) adding hydrophobic materials to the sheet to reduce the wettability of the fibers. The chemical additives used to reduce wettability are referred to as sizing agents. Typical sizing agents include rosin, alkyl ketene dimer (AKD), alkenyl succinic anhydride (ASA), styrene acrylate emulsion (SAE), polymeric surface sizing products, and lignin. U.S. Pat. No. 8,8671,055 discloses sizing agents used in traditional wet end chemistries at column 3, line 50, through column 6, line 56, and is incorporated by reference herein. U.S. Pat. No. 10,597,824 describes SAE chemistry at column 5, line 49, through column 6, line 29, and is incorporated by reference herein. U.S. Pat. No. 10,865,525 describes lignin sizing formulations and is incorporated by reference herein.

There are two categories of sizing agents, internal and surface. Internal sizing agents are typically added to the wet end of the paper machine, before sheet formation, and are incorporated into the sheet structure. The most common internal sizing agents are rosin, AKD (solid dimer), alkenyl ketene dimer (AnKD, liquid dimer), and ASA. Other sizing chemistries include wax, stearic acid, and stearic anhydride. Surface sizing agents are typically applied to the surface of a dry sheet, typically at the size press, but they can also be applied at a calender stack or a coater. The most common surface sizing agents are styrene acrylate emulsions (SAE), styrene maleic anhydride copolymers (SMA), and styrene acrylic acid copolymers (SAA). Polyurethane dispersions, ethylene acrylic acids, and fluorochemicals are also used. Many of the materials that are used as internal sizing agents can also be applied at the surface.

Sizing agents (surface or internal) are hydrophobic materials that are insoluble in water at neutral pH. For addition to the aqueous papermaking environment, these materials are either made into a water-soluble soap by reaction with a suitable alkali (e.g., rosin, SMA, SAA) or emulsified in water with a suitable stabilizer (e.g., rosin, AKD, ASA, SAE). For good distribution in the sheet it is important that these materials stay in the intended form until they have been incorporated into the papermaking system (i.e., avoid contact with other additives that may cause coagulation or precipitation before addition to the papermaking system).

Although a given for surface sizing agents, good retention is key for all internal sizing agents, both to maximize sizing and to minimize detrimental effects. Retention is typically achieved by electrostatic attraction. Cellulosic fibers and fines have an anionic charge, and the sizing agents are either cationic in nature (due to the dispersion stabilization package) or, if anionic, retained with a cationic additive (e.g., cationic starch, alum). Retention has been demonstrated to be proportional to the surface areas of the papermaking components. Due to the higher surface area of the fines and filler, a larger proportion of the sizing agent is associated with the fines and filler than the fibers. Therefore, maximizing first-pass retention of filler and fines contributes to good sizing development. Elevated-temperature drying facilitates additional distribution over cellulose surfaces, as well as the reactions necessary for sizing development with most sizing agents.

The foaming formulation used to form the foam for application to the web includes a sizing agent or sizing agents. Sizing agents are used herein to provide paper with resistance to wetting and penetration by liquid penetrants, whether aqueous or oil. The sizing agents described herein may include so-called "internal" sizing agents used primarily to increase the contact angle of polar liquids contacting the surface of the paper such as reactive sizing, including alkenyl succinic anhydride (ASA), alkenyl ketene dimer (AnKD), and alkyl ketene dimer (AKD) or other liquid or solid dimers, as well as rosin sizes. The sizing agents described herein may include so-called "surface" sizing agents, such as a styrene-acrylic polymer.

Typically, reactive sizing agents covalently link with the paper while rosin sizing may be anchored by ionic interaction between the paper and an anchoring or retention aid that is provided in conjunction with the selected sizing agents, including cationic or anionic retention aids. Thus, when rosin sizing is used, the foaming formulation may include an anchoring or retention aid. For example, the retention aid may be an aluminum salt.

In an exemplary embodiment, the foam-assisted application is performed using a foaming formulation including at least one sizing agent in an amount of from 0.01% to 50% by weight actives, based on a total weight of the foaming formulation, for example from 0.01% to 10% by weight actives, based on a total weight of the foaming formulation. It is anticipated that commercial application equipment would allow for more concentrated foam formulations than those used in the laboratory environment.

In certain embodiments, the sizing agents may also perform as the foaming agent. Thus, the foaming agent may consist of the sizing agents. In other words, the foaming formulation may include no foaming agent other than the sizing agents. In exemplary embodiments, a rosin sizing component is the sizing agent and the foaming agent.

Dry Strength Agent

In certain embodiments, the foaming formulation used to form the foam for application to the web includes a dry strength agent or agents. As used herein, "dry strength agents" provide for increased strength properties of the final paper product, measured when the paper is conditioned to equilibrium at 23° C.+/−1° C. and 50%+/−2% relative humidity. Dry strength agents typically function by increasing the total bonded area of fiber-fiber bonds, not by making the individual fibers of the web stronger. Increased bonded area of fibers, and the subsequent increased bonding-related sheet strength properties, can be achieved through other techniques as well. For example, increased fiber refining, sheet wet pressing, and improved formation may be used to increase the bonded area of fibers. In certain cases, the improvement in fiber bonding-related paper strength properties achieved through the foam-assisted application of dry strength agents was shown to be larger than the wet-end addition of the same strength agents. In particular, one advantage associated with the foam-assisted application of dry strength agents is that a higher concentration of synthetic dry strength agent can be introduced into the wet formed sheet, whereas the practical dosage range of synthetic dry strength agent limits the concentration of wet-end additives in the very low consistency environment of traditional wet-end addition. In traditional wet-end addition, the limitation of dosage of synthetic dry strength agent led to bonding-related sheet strength property "plateauing" of the dose-response curve at relatively low dosages, whereas the foam-assisted addition of synthetic dry strength agent led to a continued dosage response, where an increase in the concentration of synthetic dry strength agent applied to the wet sheet resulted in an increase in the strength properties of the resultant paper product, even at much higher than normal dose applications.

In an exemplary embodiment, the dry strength agent is a synthetic dry strength agent comprising a cationic functional group, for example a cationic strength agent or an amphoteric strength agent. It is noted that synthetic strength agents having a cationic functional group improve the bonding related strength properties of the final paper sheet.

In an exemplary embodiment, the foam-assisted application is performed using a foaming formulation including at least one dry strength agent in an amount of from 0.01% to 50% by weight solids, based on a total weight of the foaming formulation, for example from 0.01% to 10% by weight solids, based on a total weight of the foaming formulation. It is anticipated that commercial scale equipment would allow for more concentrated foam formulations than those used in a laboratory setting.

In exemplary embodiments, the synthetic dry strength agents comprise synthetic strength agents having a cationic functional group. In other embodiments, the synthetic dry strength agents comprise synthetic strength agents having an anionic functional group. In yet other embodiment, the synthetic dry strength agents comprise synthetic strength agents having an amphoteric functional group In an exemplary embodiment, the synthetic strength agent comprises a graft copolymer of a vinyl monomer and functionalized vinyl amine, a vinyl amine containing polymer, or an acrylamide containing polymer. It is noted that, as used herein, the term "synthetic" strength agent excludes natural strength agents, such as starch strength agents. In an exemplary embodiment, the at least one synthetic dry strength agent having a cationic functional group is selected from the group of: acrylamide-diallyldimethylammonium chloride copolymers; glyoxylated acrylamide-diallyldiethylammonium chloride copolymers; vinylamine, containing polymers and copolymers; polyamidoamine-epichlorohydrin polymers; glyoxylated acrylamide polymers polyethyleneimine; acryloyloxyethyltrimethyl ammonium chloride. An exemplary synthetic strength agent including a graft copolymer of a vinyl monomer and a functionalized vinyl amine.

Additionally or alternatively, in an exemplary embodiment, the at least one synthetic strength agent having a cationic functional group is selected from the group of DADMAC-acrylamide copolymers, with or without subsequent glyoxylation; Polymers and copolymers of acrylamide with cationic groups comprising AETAC, AETAS, METAC, METAS, APTAC, MAPTAC, DMAEMA, or combinations thereof, with or without subsequent glyoxylation; Vinylamine containing polymers and copolymers; PAE polymers; Polyethyleneimines; Poly-DADMACs; Polyamines; and Polymers based upon dimethylaminomethyl-substituted acrylamide, wherein: DADMAC is diallyldimethylammonium chloride; DMAEMA is dimethylaminoethylmethacrylate; AETAC is acryloyloxyethyltrimethyl chloride; AETAS is acryloyloxyethyltrimethyl sulfate; METAC is methacryloyloxyethyltrimethyl chloride; METAS is methacryloyloxyethyltrimethyl sulfate; APTAC is acryloylamidopropyltrimethylammonium chloride; MAPTAC is acryloylamidopropyltrimethylammonium chloride; and PAE is polyamidoamine-epichlorohydrin polymers.

It was also observed that synthetic dry strength agents having a cationic functional group and also containing primary amine functional units, in the form of polyvinylamine polymer units, were effective in improving strength parameters as compared to synthetic strength agents which did not contain primary amine functional units. In an exemplary embodiment, the synthetic strength agent having a cationic functional group included in the foaming formulation has a primary amine functionality of from 1 to 100%.

Foaming Agent

As indicated above, the foaming formulation used to form the foam for application to the web may include a foaming agent separate from and in addition to the sizing agents, or the sizing agents may serve as the foaming agent.

As used herein, the term "foaming agent" defines a substance which lowers the surface tension of the liquid medium into which it is dissolved, and/or the interfacial tension with other phases, to thereby be absorbed at the liquid/vapor interface (or other such interfaces). Foaming agents are generally used to generate or stabilize foams.

Foaming agents generally reduce bonding-related paper strength parameters by disrupting bonding between pulp fibers. Certain foaming agents can also have a negative impact on the sizing performance of the sheet. It was observed that the use of a foaming formulation having about the minimum amount of foaming agent sufficient to produce a foam minimizes the reduction of paper strength parameters and the negative impacts on the sizing performance. In particular, it was observed that the dosage of foaming agent required to effectively disperse a certain amount of sizing agents and, optionally, dry strength agent in a foam having gas bubbles with a mean maximum dimension or diameter of from 50 to 150 micrometers and a gas content of from 70% to 80% may vary in relation to the type and dosage of the sizing agents and optional dry strength agent, and the foaming formulation temperature and pH. This amount of foaming agent is defined herein as the "minimally sufficient" foaming agent dose, and is desirable to reduce the negative effects many foaming agents have on fiber bonding and sizing performance, and also to reduce cost and reduce potential subsequent foaming problems elsewhere in the paper machine white water circuit.

It has been determined that not all types of foaming agents are satisfactory in all circumstances. Some foaming agents, such as the anionic foaming agent sodium dodecyl sulfate (SDS), tends to result in a decrease in bonding-related strength parameters of the final paper product. SDS is conventionally known as a preferred foaming agent because of its low cost and the small dose normally required to achieve a target gas content in the foam. However, it has been discovered that the anionic charge of SDS may interfere with certain synthetic dry strength agents that have a cationic functional group and result in the formation of a gel-like association (i.e., coacervate). This association may create foam handling problems and inhibit the migration of the foamed strength agent into the web. Even under ideal circumstances (with no charge interference occurring between SDS and a cationic-group-containing dry strength agent) SDS still acts to reduce strength due to bonding interference. Certain other types of foaming agents were also unable to produce a foam of the targeted gas content range, unless cost-prohibitive concentrations of the foaming agent were used.

An investigation was performed into which foaming agents produced foams with the desired qualities of gas content and bubble size range for the foam-assisted application of certain sizing and strength agents. It was observed that improved physical parameters in the investigative paper sheet samples were obtained when the foam applied to the samples had a gas content of from 40% to 95%, for example from 60% to 80%. In an exemplary embodiment, the gas is air. In various exemplary embodiments, the foams are formed by shearing a foaming formulation in the presence of sufficient gas, or by injecting gas into the foaming solution, or by injecting the foaming solution into a gas flow.

It was also observed that improved physical properties of the paper sheet samples were obtained when the foaming formulation included one or more foaming agents in an amount of from 0.001% to 10% by weight solids, based on a total weight of the foaming formulation, for example from 0.001% to 1% by weight solids, based on a total weight of the foaming formulation. Still further, it was observed that improved physical properties of the paper sheet samples resulted when the amount of foaming agent was minimized to only about that sufficient to produce a foam with a target gas content and bubble size.

Generally, the desired foaming agent concentration results in a foam with about all of the gas bubbles within the preferred diameter range of from 50 to 150 micrometers. Adding a foaming agent in excess of about the minimally sufficient dose of foaming agent required to produce a foam with the targeted gas content increases the likelihood of loss of bonding-related strength properties and therefore the increase in the magnitude of the strength parameter loss. Use of excessive foaming agent beyond that required to produce a foam, for example using an excessive amount of foaming agent of more than 10% by weight of the foaming solution, also increases the total cost of the treatment.

It was observed that the preferred foaming agents for use in foam-assisted application of sizing agents with synthetic dry strength agents having a cationic functional group were foaming agents selected from subsets of the groups of nonionic, zwitterionic, amphoteric or cationic types of foaming agents, or combinations of the same type or more than one type of these foaming agents. In particular, preferred foaming agents are selected from the group of nonionic foaming agents, zwitterionic foaming agents, amphoteric foaming agents, and combinations thereof.

Without being bound by theory, the improved results in strength parameters obtained by the nonionic and zwitterionic or amphoteric foaming agents were believed to be due to the lack of electrostatic interaction between these types of foaming agents and the pulp fibers and the synthetic cationic strength agents. In particular, improved results were obtained through the use of nonionic foaming agents selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polygulocosides, alkyl glycol ether, polyoxyalkylene alkyl ethers, polyvinyl alcohols, alkyl polysaccharides, their derivatives and combinations thereof.

Improved results in strength parameters were also obtained through the use of zwitterionic or amphoteric foaming agents selected from the group of lauryl dimethylamine oxide, cocoamphoacetate, cocoamphodiacetate, cocoamphodiproprionate, cocamidopropyl betaine, alkyl betaine, alkyl amido betaine, hydroxysulfo betaine, cocamidopropyl hydroxysultain, alkyliminodipropionate, amine oxide, amino acid derivatives, alkyl dimethylamine oxide and nonionic surfactants such as alkyl polyglucosides and poly alkyl polysaccharide and combinations thereof.

It was observed that anionic foaming agents may also produce improved results in strength parameters when combined with synthetic strength agents having a cationic functional group that have a relatively low cationic charge, for example a molar concentration of cationic functional groups of below around 16%. Preferred anionic foaming agents are foaming agents selected from the group of alkyl sulfates and their derivatives, alkyl sulfonates and sulfonic acid derivatives, alkali metal sulforicinates, sulfonated glyceryl esters of fatty acids, sulfonated alcohol esters, fatty acid salts and derivatives, alkyl amino acids, amides of amino sulfonic acids, sulfonated fatty acids nitriles, ether sulfates, sulfuric esters, alkylnapthylsulfonic acid and salts, sulfosuccinate and sulfosuccinic acid derivatives, phosphates and phosphonic acid derivatives, alkyl ether phosphate and phosphate esters, and combinations thereof.

It was observed that cationic foaming agents may also produce improved results in strength parameters when combined with synthetic strength agents having a cationic functional group that have a relatively low cationic charge, for example a molar concentration of cationic functional groups of below around 16%. Preferred cationic foaming agents are foaming agents selected from the group of alkyl amine and amide and their derivatives, alkyl ammoniums, alkoxylated amine and amide and their derivatives, fatty amine and fatty amide and their derivatives, quaternary ammoniums, alkyl quaternary ammoniums and their derivatives and their salts, imidazolines derivatives, carbyl ammonium salts, carbyl phosphonium salts, polymers and copolymers of structures described above, and combinations thereof.

Combinations of the above-described foaming agents are also disclosed herein. Combining certain different types of foaming agents allows for the combination of different benefits. For example, anionic foaming agents are generally cheaper than other foaming agents and are generally effective at producing foam, but may not be as effective at improving the bonding-related strength properties of paper. Nonionic, zwitterionic or amphoteric foaming agents are generally more costly than anionic foaming agents, but are generally more effective in conjunction with synthetic strength agents having a cationic functional group at improving strength properties. As such, the combination of an anionic and a nonionic, zwitterionic, and/or amphoteric foaming agent may provide the dual benefits of being cost-effective whilst also improving strength properties of the paper sheet, or at least provide a compromise between these two properties. Foaming agents may also be combined to take advantage of the high foaming capabilities of one type of foaming agent and the better bonding improvement properties of another type of foaming agent. With certain combinations, there exists a synergistic improvement in bonding-related strength properties with the use of certain foaming agents and certain strength agents having a cationic functional group, for example cationic or amphoteric strength agents. Anionic or non-ionic strength agents may also exhibit such synergies with certain foaming agents or combinations thereof.

In an exemplary embodiment, the foaming agent is poly (vinyl alcohol), also called polyvinylalcohol, PVA, PVOH, or PVA1 and its derivatives. The combination of a PVOH foaming agent and a strength agent having a cationic functional group was observed to provide improved strength properties on the samples as compared to those resulting from wet-end addition of the same synthetic cationic strength agent. Polyvinyl alcohol foaming agents with higher molecular weight, a lower degree of hydrolysis and the absence of defoamers typically provided good strength properties through the foam-assisted application of strength agents. In an exemplary embodiment, the polyvinyl alcohol has a degree of hydrolysis of between around 70% and 99.9%, for example between around 86 and around 90%. In an exemplary embodiment, the polyvinyl alcohol foaming agent has a number average molecular weight of from 5000 to 400,000, resulting in a viscosity of from 3 to 75 cP at 4% solids and 20° C. In an exemplary embodiment, the polyvinyl alcohol foaming agent has a number average molecular weight of from 70,000 to 100,000, resulting in a viscosity of from 45 to 55 cP at 4% solids and 20° C. It is also noted that polyvinyl alcohol-based foaming agents advantageously do not weaken paper-strength parameters by disrupting bonding between pulp fibers of the web. A combination of a nonionic, zwitterionic, or amphoteric foaming agent with a polyvinyl alcohol foaming agent (or its derivatives) at other molecular weights and degrees of hydrolysis also provided good foam qualities and good strength improvements in conjunction with cationic strength agents.

It was also observed that improved physical parameters in the samples were obtained when the foaming agents used had a hydrophilic-lipophilic balance (HLB) of above around 8. A HLB balance of above around 8 promotes the ability to produce foams in aqueous compositions.

Without being bound by theory, it may be that the improvement in wetting resistance and strength properties that is achieved through the foam-assisted application of certain sizing and strength agents as compared to wet-end addition of the same agents is due to better retention of the agents with foam-assisted application. In particular, since the foamed application of agents is performed when the sheet has a higher concentration of fibers to water (with the water content typically being from 70 to 90%) as compared to the wet-end addition of agents to the pulp in the stock preparation sections (where the water content is typically from 95 to 99% or more), less agent loss occurs when the pulp is passed through subsequent water removal sections. In exemplary embodiments, the step of applying foam to the web is performed when the web has a pulp fiber consistency of from 5% to 45%, for example from 5% to 30%.

Without being bound by theory, it is believed that the improvement in wetting resistance and paper strength parameters resulting from the foam-assisted application of certain sizing and strength agents as compared to the wet-end addition of the same agents is because contaminating substances/contaminants that interfere with the additive adsorption of the sizing and strength agents onto the fibers may be present in greater quantities in the stock preparation section, particularly in the thin stock section.

Without being bound by theory, it is believed that the improvement in wetting resistance and strength parameters resulting from the foam-assisted application of certain sizing and strength agents as compared to the wet-end addition of the same agents is that, because the sizing and strength agents are incorporated into the sheet at least in part by a physical means instead of only by a surface charge means, a lack of remaining available charged sites in the forming web does not limit the amount of sizing or strength agent that can be incorporated into the sheet. A lack of remaining available charged bonding sites in the forming web, such as a lack of remaining available anionic charged sites, may occur when additives are introduced by wet-end addition, especially when large amounts of additives are introduced in this manner Alternatively or additionally, and without being bound by theory, the improved wetting resistance and strength could be due to the unique sizing agent and dry strength agent distribution in the sheet provided by embodiments herein. Rather than uniform distribution throughout, it is believed that the foam application concentrates the sizing agent distribution and dry strength agent distribution in the sheet in targeted areas.

Foam-Assisted Application

In an exemplary embodiment, the foam-assisted application of sizing agents and optional dry strength agent occurs with the foam having an air content of from 40% to 95%, for example from 70% to 90%, based on a total volume of the foam. The foam may be formed by injecting gas into a foaming formulation, by shearing a foaming formulation in the presence of sufficient gas, by injecting a foaming formulation into a gas flow, or by other suitable means.

In an exemplary embodiment, the foam is produced with a foam density of from 50 to 300 g/L, for example, from 100 to 300 g/L, such as from 150 to 300 g/L.

In an exemplary embodiment, when applying the foam to a wet web, the foam is applied at a foam coverage level of from 30 to 300 wet g/m$^2$, such as less than 200 wet g/m$^2$, for example, from 60 to 150 wet g/m$^2$.

In an exemplary embodiment, when applying the foam to the web, the foam is applied such that a dosage of the sizing agent or agents to the wet web is at least 0.01% actives, such as at least 0.025% actives, and no more than 1.2% actives, such as no more than 0.8% actives, all based on the web dry weight.

In an exemplary embodiment, when applying the foam to the web, the foam is applied such that a dosage of the synthetic dry strength agent or agents to the wet web is at least 0.075% actives, such as at least 0.2% actives, and no more than 1.2% actives, such as no more than 0.8% actives, all based on the web dry weight.

In an exemplary embodiment, when applying the foam to the web, the web is from 5 to 20% solids, for example, 5 to 15% solids or 8 to 15% solids.

Without being limited by theory, it is noted that a commercially available foam generator can be used to produce suitable foam for foam assisted additive addition at pilot scale or commercial scale. Suitable commercially available foam generators sometimes produce foam by high shear caused by close clearance in a rotary device, by an oscillating device, by air induction, or by other suitable means. Most are pressurized, which is convenient for feeding the foam to a foam distributor over the web forming device. When excess gas is added into a pressurized foam generator, beyond what the foam generator can disperse as acceptable quality foam (10 to 300 μm bubbles), the excess gas is discharged (with the foam) as very large 2 to 20 mm diameter bubbles, dispersed within the foam. Bubbles of 2 to 20 mm diameter are much larger in diameter than the typical thickness of the wet web or the foam layer. Since sizing agents and optional synthetic dry strength agent are only found in the liquid film and interstice area of the bubbles in the foam, very large diameter bubbles cannot deliver the sizing agents and synthetic dry strength agent to the fiber crossing area if a large area of the sheet has only the film over a single bubble applied to the sheet. Bubbles smaller than the foam layer thickness or the wet web thickness are preferred for a more even distribution of sizing agents and dry strength agent. Bubbles of from 20 to 300 μm diameter are preferred, especially bubbles of from 50 to 150 μm diameter, for this application, because bubbles of this size can carry the sizing agents into the wet web and synthetic dry strength agent into the wet web without disruption of the web and can therefore more efficiently distribute the sizing agents and strength agent. A foam containing bubbles of from 50 to 150 μm diameter and from 70 to 80% air is convenient because it can be poured readily from an open top container. A foam containing up to from 90 to 95% air can be conveyed by pressure through a hose to and out of a foam distributor for application to the web. Most foam generators cannot reliably produce acceptable quality foam for the described purpose with more than about 90% air.

EXAMPLES

Evaluations were made on the Solenis Pilot Machine unit. U.S. Pat. No. 8,871,055 provides a description of an exemplary pilot paper machine, along with references for the sizing tests. A standard recycled linerboard model was used with a combination of 80% recycled medium and 20% old newsprint, both refined to 425 mL CSF. Paper was made to a target basis weight of approximately 80 lb/3000 sq ft and 55 #/ton of SLS was added in the wet-end to mimic anionic trash. Foam was generated on an Oakes Foam Generator system with the sizing agents in combination with a Solenis proprietary foaming agent (DPD-934). The foam was applied to the wet web through a slot die mounted above the forming table prior to the last (third) vacuum box.

In Examples/Comparative Examples 1-3, sheets were made with 0.02% Perform™ PC8713 Retention/Drainage/Clarification Aid and 0.3% Perform™ PM9025 E Retention/Drainage/Clarification Aid added to the wet-end (dry basis). Sizing agents (Hercon™ 615 Sizing Agent, Precis™ 2090 Sizing Agent, and Prequel™ 2000 Sizing Agent) were applied to either the wet-end, prior to retention aids, or via foam application prior to the last vacuum box. Hercon™ 615 Sizing Agent is a dispersion which contains solid dimer (AKD which is a solid at room temperature), Precis™ 2090 Sizing Agent is a dispersion which contains liquid dimer (AnKD which is a liquid at room temperature), and Prequel™ 2000 Sizing Agent contains ASA which must be emulsified prior to use.

In Examples/Comparative Examples 4 and 5 no retention aid package was applied. In Example/Comparative Example 4 no other wet-end additives were applied to the sheet. In Example/Comparative Example 5 Hercobond™ 6950 Paper Performance Additive was applied to the wet-end prior to sizing agent addition.

Sheets were tested for sizing performance with the Cobb test and the Hercules Size Test (HST). For the Cobb test, water was applied to the indicated side of the sheet and the weight gain after 2 minutes was recorded. In the HST testing, #2 ink (1% formic acid and dye) is applied to the indicated side and the time to reach a reflectance of 80% on the opposite side of the sheet is recorded. The aforementioned "indicated side" is shown in parenthesis where applicable, for example by "(wire side)" or "(felt side)". In all cases, the Comparative Example is the wet-end application of the additive and the Example is the foam application. Given the nature of the foam application in this model there is some non-uniformity in the coverage of the sheet. In cases where high variation was observed in the testing (i.e., high coefficient of variation), the dosage point results were removed from the analysis as it is likely indicative of poor/nonuniform foam coverage. This poor coverage was observed visually at the point of foam application. It is anticipated that the equipment used on a commercial scale will improve the foam coverage uniformity and the results would likely be better on a larger scale.

Precis 2090 was applied in Example 1/Comparative Example 1. There were clear improvements in the HST test values at lower dosages of the sizing agent when applied via foam. Values of >200 seconds were obtained at 0.15% (wire side) and 0.2% (felt side) in foam application whereas these values were not obtained until the 0.4% dosage in the wet-end. It is difficult to interpolate the curves due to the error and non-linearity, but there is a clear reduction in sizing agent required to achieve the same level of HST sizing. Similar results were observed in the Cobb analysis. The foam applied systems showed much lower Cobb water pick up at lower dosages. Both sides of the sheet gave <150 gsm pick up at a 0.2% dosage whereas much higher dosages were required in the wet-end application to achieve a similar result.

Hercon 615 was applied in Example 2/Comparative Example 2. With this chemistry, the foam application showed an improvement in HST results on the wire side testing, but the felt side was comparable to wet-end application. There was some relatively large error in the readings so it is possible that the foam coverage was not uniform and that is impacting the results. Cobb analysis did show a significant improvement with foam application of the chemistry. Cobb values of less than 50 gsm were obtained at the lowest dosage (0.1%). The wet-end application did not show comparable results until 0.2% dosage (wire side testing) and 0.4% dosage (felt side testing).

For the Prequel 2000 results (Example 3/Comparative Example 3), the foam application approach achieved Cobb values of less than 40 gsm for both sides at a dosage of 0.15%. In the wet-end application, values of <40 gsm were not obtained until the dosage was at 0.4%. The HST analysis showed differentiation in the foam application between the wire and felt side testing.

When Precis 2090 was applied with no other additives (Example 4/Comparative Example 4), the foam application approach demonstrated significant improvements in Cobb and HST compared to the wet-end application. In Cobb testing, the foam approach gave values that were not obtained up to 0.15% dosage in the wet-end. HST showed similar results with much better responsiveness in foam application than the wet-end.

When a dry strength agent was added to the operation with Precis 2090 (Example 5/Comparative Example 5), the foam application again showed significant improvements in Cobb and HST sizing. Dosage reductions of 50% were demonstrated in the Cobb testing with similar sizing result.

TABLES 1-4 include data for Examples/Comparative Examples 1-3 and FIGS. 2A-2F and 3A-3D are sizing results plots for Examples/Comparative Examples 1-3.

TABLE 1

Table 1: Cobb Sizing Data collected with application to the felt side of the paper. The sizing agent used is listed in the second column.

| | | Cobb 2 Minute Water Soak (gsm) - Felt Side | | | | |
|---|---|---|---|---|---|---|
| | Dosage==> | 0% | 0.10% | 0.15% | 0.20% | 0.40% |
| Comparative Example 1 | Precis 2090 | 298 +/− 13 | 232 +/− 1 | 236 +/− 1 | 202 +/− 1 | 73 +/− 1 |
| Example 1 | Precis 2090 | 326 +/− 4 | 230 +/− 0 | 158 +/− 1 | 36 +/− 1 | |
| Comparative Example 2 | Hercon 615 | 298 +/− 13 | 258 +/− 1 | 147 +/− 4 | 100 +/− 4 | 32 +/− 6 |
| Example 2 | Hercon 615 | 326 +/− 4 | 41 +/− 2 | | 22 +/− 0 | |
| Comparative Example 3 | Prequel 2000 | 298 +/− 13 | 225 +/− 6 | 124 +/− 21 | 49 +/− 0 | 25 +/− 1 |
| Example 3 | Prequel 2000 | 326 +/− 4 | 221 +/− 1 | 35 +/− 6 | 25 +/− 1 | |
| | Dosage==> | 0% | 0.07% | 0.11% | 0.15% | 0.30% |
| Comparative Example 4 | Precis 2090 | 317 +/− 1 | 309 +/− 4 | 304 +/− 4 | 276 +/− 0 | |
| | Dosage==> | 0% | 0.10% | 0.15% | 0.20% | 0.40% |
| Example 4 | Precis 2090 | 322 +/− 2 | 209 +/− 29 | 66 +/− 2 | 44 +/− 5 | |
| | Dosage==> | 0% | 0.07% | 0.11% | 0.15% | 0.30% |
| Comparative Example 5 | Precis 2090 | | 299 +/− 13 | 277 +/− 12 | 242 +/− 1 | 83 +/− 0 |
| | Dosage==> | 0% | 0.10% | 0.15% | 0.20% | 0.40% |
| Example 5 | Precis 2090 | 319 +/− 3 | 118 +/− 4 | 47 +/− 7 | 37 +/− 3 | |

TABLE 2

Table 2: Cobb Sizing Data collected with application to the wire side of the paper. The sizing agent used is listed in the second column.

| | | Cobb 2 Minute Water Soak (gsm) - Wire Side | | | | |
|---|---|---|---|---|---|---|
| | Dosage==> | 0% | 0.10% | 0.15% | 0.20% | 0.40% |
| Comparativa Example 1 | Precis 2090 | 293 +/− 6 | 225 +/− 5 | 228 +/− 1 | 192 +/− 6 | 41 +/− 1 |
| Example 1 | Precis 2090 | 327 +/− 3 | 225 +/− 1 | | 138 +/− 1 | |
| Comparative Example 2 | Hercon 615 | 293 +/− 6 | 231 +/− 4 | 86 +/− 2 | 40 +/− 2 | 25 +/− 0 |
| Example 2 | Hercon 615 | 327 +/− 3 | 44 +/− 4 | 27 +/− 6 | 32 +/− 16 | |
| Comparative Example 3 | Prequel 2000 | 293 +/− 6 | 198 +/− 6 | 107 +/− 4 | 58 +/− 1 | 25 +/− 1 |
| Example 3 | Prequel 2000 | 327 +/− 3 | 227 +/− 3 | 34 +/− 8 | 23 +/− 0 | |
| | Dosage==> | 0% | 0.07% | 0.11% | 0.15% | 0.30% |
| Comparative Example 4 | Precis 2090 | 315 +/− 1 | 273 +/− 4 | 272 +/− 3 | 224 +/− 4 | |
| | Dosage==> | 0% | 0.10% | 0.15% | 0.20% | 0.40% |
| Example 4 | Precis 2090 | 317 +/− 6 | 194 +/− 2 | 125 +/− 6 | 79 +/− 7 | |
| | Dosage==> | 0% | 0.07% | 0.11% | 0.15% | 0.30% |
| Comparative Example 5 | Precis 2090 | | 280 +/− 2 | 253 +/− 3 | 198 +/− 11 | 43 +/− 2 |
| | Dosage==> | 0% | 0.10% | 0.15% | 0.20% | 0.40% |
| Example 5 | Precis 2090 | 302 +/− 3 | 182 +/− 8 | 120 +/− 15 | 75 +/− 5 | |

TABLE 3

Table 3: Hercules Size Test Data collected with application to the felt side of the paper. The sizing agent used is listed in the second column.

| | | Hercules Size Test (seconds) - Felt Side | | | | |
|---|---|---|---|---|---|---|
| | Dosage==> | 0% | 0.10% | 0.15% | 0.20% | 0.40% |
| Comparative Example 1 | Precis 2090 | 2 +/− 0 | 92 +/− 23 | 42 +/− 0 | 104 +/− 13 | 501 +/− 33 |
| Example 1 | Precis 2090 | 2 +/− 0 | 65 +/− 17 | 121 +/− 14 | 263 +/− 41 | |

TABLE 3-continued

Table 3: Hercules Size Test Data collected with application to the felt side of the paper. The sizing agent used is listed in the second column.

| | | Hercules Size Test (seconds) - Felt Side | | | | |
|---|---|---|---|---|---|---|
| Comparative Example 2 | Hercon 615 | 2 +/− 0 | 43 +/− 4 | 191 +/− 19 | 428 +/− 39 | >2000 |
| Example 2 | Hercon 615 | 2 +/− 0 | 95 +/− 54 | 113 +/− 20 | 677 +/− 118 | |
| Comparative Example 3 | Prequel 2000 | 2 +/− 0 | 64 +/− 4 | 202 +/− 24 | 395 +/− 31 | |
| Example 3 | Prequel 2000 | 2 +/− 0 | 9 +/− 4 | 48 +/− 11 | 69 +/− 5 | |
| | Dosage==> | 0% | 0.07% | 0.11% | 0.15% | 0.30% |
| Comparative Example 4 | Precis 2090 | 1 +/− 0 | 5 +/− 0 | 10 +/− 1 | 30 +/− 6 | |
| | Dosage==> | 0% | 0.10% | 0.15% | 0.20% | 0.40% |
| Example 4 | Precis 2090 | 1 +/− 0 | 72 +/− 18 | 185 +/− 54 | 350 +/− 131 | |
| | Dosage==> | 0% | 0.07% | 0.11% | 0.15% | 0.30% |
| Comparative Example 5 | Precis 2090 | | 8 +/− 1 | 20 +/− 3 | 57 +/− 7 | 462 +/− 58 |
| | Dosage==> | 0% | 0.10% | 0.15% | 0.20% | 0.40% |
| Example 5 | Precis 2090 | 0 +/− 0 | 102 +/− 12 | 214 +/− 23 | 480 +/− 194 | |

TABLE 4

Table 4: Hercules Size Test Data collected with application to the wire side of the paper. The sizing agent used is listed in the second column.

| | | Hercules Size Test (seconds) - Wire Side | | | | |
|---|---|---|---|---|---|---|
| | Dosage==> | 0% | 0.10% | 0.15% | 0.20% | 0.40% |
| Comparative Example 1 | Precis 2090 | 2 +/− 0 | 64 +/− 10 | 34 +/− 3 | 55 +/− 4 | 404 +/− 57 |
| Example 1 | Precis 2090 | 2 +/− 0 | 115 +/− 33 | 249 +/− 29 | 415 +/− 35 | |
| Comparative Example 2 | Hercon 615 | 2 +/− 0 | 31 +/− 4 | 96 +/− 7 | 293 +/− 50 | >2000 |
| Example 2 | Hercon 615 | 2 +/− 0 | 222 +/− 18 | 344 +/− 85 | 608 +/− 86 | |
| Comparative Example 3 | Prequel 2000 | 2 +/− 0 | 50 +/− 6 | 173 +/− 26 | 370 +/− 29 | 434 +/− 12 |
| Example 3 | Prequel 2000 | 2 +/− 0 | 171 +/− 38 | 254 +/− 7 | 284 +/− 21 | |
| | Dosage==> | 0% | 0.07% | 0.11% | 0.15% | 0.30% |
| Comparative Example 4 | Precis 2090 | 2 +/− 0 | 7 +/− 1 | 12 +/− 1 | 31 +/− 5 | |
| | Dosage==> | 0% | 0.10% | 0.15% | 0.20% | 0.40% |
| Example 4 | Precis 2090 | 1 +/− 0 | 268 +/− 36 | 405 +/− 37 | 654 +/− 74 | |
| | Dosage==> | 0% | 0.07% | 0.11% | 0.15% | 0.30% |
| Comparative Example 5 | Precis 2090 | | 11 +/− 2 | 22 +/− 5 | 51 +/− 12 | 371 +/− 107 |
| | Dosage==> | 0% | 0.10% | 0.15% | 0.20% | 0.40% |
| Example 5 | Precis 2090 | 1 +/− 1 | 273 +/− 28 | 492 +/− 48 | 670 +/− 97 | |

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for manufacturing a sized paper product, the method comprising:

producing a foam of water, air, a foaming agent, and a reactive sizing agent;

applying the foam directly to an embryonic web having a dry solids consistency of from about 5% to about 20% to form a wet web, wherein the foam is applied to the embryonic web at a location between a first high vacuum box and a second high vacuum box on a forming section of a papermaking machine;

vacuuming the wet web with the second high vacuum box to pull the foam into the wet web; and processing the wet web to form the product.

2. The method of claim 1, wherein the foam has a foam density of from 50 to 300 g/L.

3. The method of claim 1, wherein the embryonic web has a surface, and wherein the foam is applied to the surface of the embryonic web at a foam coverage level of from 30 to 300 wet g/m$^2$.

4. The method of claim 1, wherein the wet web comprises no more than 96 wt % water after the foam is applied.

5. The method of claim 1, wherein the wet web comprises no more than 90 wt % water after the foam is applied.

6. The method of claim 1, wherein processing the wet web to form the product comprises performing pressing, molding, and/or drying processes.

7. The method of claim 1, wherein the reactive sizing agent is selected from alkenyl succinic anhydride (ASA), alkenyl ketene dimer (AnKD), alkyl ketene dimer (AKD), a liquid dimer, a solid dimer, and combinations thereof.

8. The method of claim 1, wherein the foam further comprises a dry strength agent.

9. The method of claim 1, further comprising concentrating the sizing agent at a targeted region within the product.

10. The method of claim 1, wherein the foam has gas bubbles with a mean diameter of from 50 to 150 micrometers and a gas content of from 70% to 80%, (( ) and wherein a dosage of the reactive sizing agent applied to the embryonic web is from about 0.01% to about 1.2% actives based on web dry weight.

11. The method of claim 1, wherein the reactive sizing agent is selected from the group consisting of alkenyl succinic anhydride (ASA), alkenyl ketene dimer (AnKD), and alkyl ketene dimer (AKD) (and wherein the foam application achieves a target sizing property at a lower dosage of the reactive sizing agent than wet-end application of the same reactive sizing agent.

12. The method of claim 1, wherein the reactive sizing agent is alkenyl ketene dimer (AnKD), wherein the foam further comprises a dry strength agent, and wherein the foam application achieves a target Cobb value at about 50% or less of the dosage of the reactive sizing agent required to achieve the same target Cobb value by wet-end application.

13. A method for manufacturing a sized paper product, the method comprising:

applying a foam to an embryonic web having a dry solids consistency of from about 5% to about 20% on a forming section of a papermaking machine, wherein the foam comprises a reactive sizing agent, and wherein the foam is applied at a location between a first high vacuum box and a second high vacuum box on the forming section; and vacuuming the embryonic web with the second high vacuum box to pull the foam into the embryonic web; and concentrating the sizing agent at a targeted region within the embryonic web while processing the embryonic web to form the product.

14. The method of claim 13, wherein the foam has a foam density of from 50 to 300 g/L.

15. The method of claim 13, wherein the embryonic web has a surface, and wherein the foam is applied to the surface of the embryonic web at a foam coverage level of from 30 to 300 wet g/m$^2$.

16. The method of claim 13, wherein the sizing agent also serves as a foaming agent.

17. The method of claim 13, wherein the foam further comprises a dry strength agent.

18. A method for introducing a reactive sizing agent into a paper product, the method comprising:

producing a foam of water, air, and the reactive sizing agent;

applying the foam to an embryonic web having a dry solids consistency of from about 5% to about 20%, wherein the foam is applied at a location between a first high vacuum box and a second high vacuum box on a forming section of a papermaking machine;

vacuuming the embryonic web with the second high vacuum box to pull the foam into the embryonic web; and processing the embryonic web to form the paper product.

19. The method of claim 18, wherein the reactive sizing agent performs as a foaming agent.

20. The method of claim 19, wherein the reactive sizing agent is alkenyl succinic anhydride (ASA), and wherein the foam is applied such that a dosage of the reactive sizing agent to the embryonic web is from about 0.01% to about 0.8% actives based on web dry weight.

* * * * *